US006241468B1

(12) United States Patent
Lock et al.

(10) Patent No.: US 6,241,468 B1
(45) Date of Patent: Jun. 5, 2001

(54) COOLANT PASSAGES FOR GAS TURBINE COMPONENTS

(75) Inventors: Gary D Lock, Bath; Martin L G Oldfield, Oxford, both of (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/401,993

(22) Filed: Sep. 23, 1999

(30) Foreign Application Priority Data

Oct. 6, 1998 (GB) ..... 9821639

(51) Int. Cl.[7] ..... F01D 5/14
(52) U.S. Cl. ..... 415/115; 416/96 R
(58) Field of Search ..... 415/115, 116; 416/96 R, 96 A, 97 A, 97 R, 92

(56) References Cited

U.S. PATENT DOCUMENTS

| | | | | |
|---|---|---|---|---|
| 2,149,510 | | 3/1939 | Darrieus . | |
| 2,220,420 | | 11/1940 | Meyer . | |
| 2,489,683 | | 11/1949 | Stalker . | |
| 3,515,499 | | 6/1970 | Beer . | |
| 3,527,543 | | 9/1970 | Howald . | |
| 4,026,659 | | 5/1977 | Freeman . | |
| 4,314,442 | * | 2/1982 | Rice | 60/39.05 |
| 4,565,490 | * | 1/1986 | Rice | 415/114 |
| 4,664,597 | * | 5/1987 | Auxier et al. | 416/97 R |
| 4,676,719 | * | 6/1987 | Auxier et al. | 416/97 R |
| 5,419,681 | * | 5/1995 | Lee | 416/97 R |

FOREIGN PATENT DOCUMENTS

| | | |
|---|---|---|
| 586838 | 4/1947 | (GB) . |
| 798865 | 6/1958 | (GB) . |
| 1033759 | 6/1966 | (GB) . |
| 1550368 | 8/1979 | (GB) . |
| 2165315 | 4/1986 | (GB) . |
| 207799 | 1/1987 | (GB) . |
| 55-114806 | 9/1980 | (JP) . |

* cited by examiner

*Primary Examiner*—Edward K. Look
*Assistant Examiner*—James M McAleenan
(74) *Attorney, Agent, or Firm*—W. Warren Taltavull; Manelli Denison & Selter PLLC

(57) ABSTRACT

A gas turbine engine component, typically either a turbine blade or vane or combustor, comprising a wall (40) with a first surface (39) which is adapted to be supplied with a flow of cooling air, and a second surface (38) which is adapted to be exposed to a hot gas stream (50). The wall (40) further having defined therein a plurality of passages (57), the passages (57) defined by passage walls (54), which interconnect a passage inlet (31) in said first surface (39) to a passage outlet (32) in said the second surface (38). The passages (57), cooling air and the hot gas stream (50) arranged such that in operation a flow (52) of cooling air is directed through said passages (57) to provide a flow (36) of cooling air over at least a portion of the second surface (39). The cross sectional area of each of the passages (57) progressively decreasing overall, in the direction of cooling air flow (52) through the passage (57), such that in use the flow of cooling air (52) through the passage (57) is accelerated. The passage walls (54) of the cooling passages (57) preferably diverging laterally across the wall (40) of the component whilst perpendicular to the wall (40) they converge so that overall the cross-sectional area decreases.

19 Claims, 3 Drawing Sheets

COOLANT PASSAGES FOR GAS TURBINE COMPONENTS

THE FIELD OF THE INVENTION

The present invention relates generally to cooling arrangements for gas turbine components and in particular to improvements to the arrangement and configuration of cooling passages which are provided within the walls of a component and are arranged to provide film cooling of the component.

BACKGROUND OF THE INVENTION

Certain components, in particular in the combustor and turbines, of a gas turbine engine are subject, in operation, to high temperature gas flows. In some cases the high temperature gas flows are at temperatures above the melting point of the component material. In order to protect the components, and in particular the surface of the components adjacent to the high temperature gas flows, from these high temperatures, various cooling arrangements are provided.

Generally such arrangements utilise relatively cool compressed air, which is bled from the compressor section of the gas turbine engine, to cool and protect the components subject to the high operating temperatures.

A well known method of cooling and protecting gas turbine components from the high temperature gas flows is film cooling in which a film of cooling air is provided along the surface of the component exposed to the high temperature gas flows. The film of cooling air is produced by conducting a flow of cooling air through a plurality of passages which perforate the wall of the component. The air exiting the passages is directed, by the passages, to flow in a boundary layer along surface of the component. This cools the wall of the component exposed to the high temperature gas flow and provides a protective film of cool air between the high temperature gas flow and the component surface. The protective film assists in keeping the high temperature gas flow away from the surface of the component wall.

The arrangement and configuration of the passages are carefully designed to provide, and ensure, an adequate boundary layer flow of cooling air along the surface of the component. The passages are accordingly generally angled in the flow direction of the hot gas stream so that the cooling air flows in a downstream direction over the surface of the component.

Ideally it is desired that the boundary layer should flow over substantially the entire surface of the component downstream of the passages. However it has been found that the cooling air leaving the passage exit generally forms a cooling stripe no wider than, or hardly wider than, the dimension of the exit of the passage. Limitations on the number, size, and spacing of the passages results in gaps in the protective cooling layer provided and/or areas of reduced protection/cooling.

To overcome this it has been proposed, in for example U.S. Pat. No. 3,527,543, to use divergent passages where the cross section of the passages increases towards the passage exit at the surface of the component exposed to the hot gas flow. The cooling air which flows through the passages is thereby partially spread out over a larger area of the surface. Whilst this is an improvement over a constant cross section passage it has been found that the air exiting the passage generally still does not spread out enough to provide a continuous film of cooling air between the typical spacing of the passages.

A further development of the diverging passages is to arrange the passages sufficiently close to each other such that the outlets of the adjacent passages, on the surface of the component exposed to the hot gas flows, intersect laterally to define a common outlet in the form of a laterally extending slot. The cooling air expands as it passes though the passages and exits from this common slot as a substantially continuous film. Such an arrangement is described more fully in U.S. Pat. No. 4,676,719 which also references other similar arrangements which are described in U.S. Pat. No. 3,515,499 and Japanese Patent Number 55-114806.

In these prior art arrangements the passages are divergent and the cross sectional area of the passage increases towards the exit. This slows down, and diffuses, the flow of cooling air therethrough. As is taught in the prior art this slowing of the flow is important in assisting in spreading the flow of cooling air, in a boundary layer, along and over the surface of the component. Another important consideration in the design of such film cooling arrangements is to ensure that a stable boundary layer is provided over the surface of the component, and that this boundary layer remains attached to the surface of the component to thereby protect the surface from the high temperature gas stream. This boundary layer flow of cooling air is also required to withstand fluctuations and variations in the hot gas stream, that may occur during operation, to ensure that adequate cooling and protection is provided throughout the operation of the engine. In addition the flow through the passages and along the surface of the component should be as aerodynamically efficient as possible.

In an additional variation slots within the walls of the component can be used to direct the cooling air to the outer surface of the component. Such an arrangement is described in U.S. Pat. Nos. 2,149,510, 2,220,420 and 2,489,683.

Although such arrangements provide a good flow of cooling air along and over the surface of the component the structural strength of the walls of the component is reduced. This is also true, albeit to a lesser extent, with the arrangements where the passages intersect at their exits to form a common exit slot.

It is therefore desirable to provide an improved gas turbine engine component cooling arrangement and configuration, and in particular to provide an improved arrangement and configuration of cooling passages that address the above mentioned problems and/or offers improvements to such cooling arrangements generally.

SUMMARY OF THE INVENTION

According to the present invention there is provided a gas turbine engine component comprising a wall with a first surface which is adapted to be supplied with a flow of cooling air, and a second surface which is adapted to be exposed to a hot gas stream, the wall further has passage walls which define therein a plurality of passages, which interconnect passage inlets in said first surface of the component to passage outlets in said the second surface, the passages, passage walls defining the passages, cooling air and the hot gas stream arranged such that in operation a flow of cooling air is directed from the passage inlets to the passage outlets through said passages to provide a flow of cooling air over at least a portion of the second surface; wherein a cross sectional area of each of the passages in a direction of cooling air flow through a passage, progressively decreases overall from the passage inlets to the passage outlets such that in use the flow of cooling air from the passage inlets to the passage outlets through each passage is accelerated.

Preferably the passage outlet in said second surface comprises a slot defined by the passage in said second surface. The passage inlet in said first surface preferably has a different shape to the passage outlet slot.

The passage outlets of at least two of the plurality of passages may be combined to produce a common outlet.

Preferably at the passage outlet of at least two adjacent passages, at least part of the passage walls defining the adjacent passages substantially intersect the second surface of the wall exposed to the hot gas stream.

The cross section, substantially perpendicular to the direction of flow through the passage, of the passage inlet may be substantially circular or elliptical or rectangular Preferably the passage walls, which define the passages through the walls of the component, are profiled such that in a first direction substantially perpendicular to a cooling flow direction through the passage they converge towards a centre line through the passage, and in a second direction also perpendicular to a flow direction through the passage they diverge from the centre line of the passage. Furthermore the first direction in which the passage walls diverge may be substantially parallel to the first and second surfaces of the wall of the component, and the second direction may be substantially perpendicular to the first direction and the centre line through the passage, such that from the passage inlet to the passage outlet the passage walls that define the passages are configured to diverge in the first direction laterally across the wall of the component and also simultaneously converge in the second direction.

The passages through the walls of the component may be angled in a flow direction of the hot gas stream that is arranged in operation to flow adjacent to the second surface of the component.

Preferably at the passage inlets, where the walls of the passages and the first surface of the wall of the component intersect, a rounded profile is defined between the passage walls and the first surface. Furthermore at the passage outlets, where the walls of the passages and the second surface of the wall of the component intersect, a rounded profile is defined between the passage walls and second surface.

A portion of the second surface of the wall exposed to hot gas stream downstream of a passage outlet may be lower than a portion of the second surface upstream of the passage outlet.

The passages may be curved as they pass through the wall of the component. The passage walls that define the passages may have a curved profile.

The component is part of a turbine section of a gas turbine engine. Furthermore the component may be a hollow turbine blade or a hollow turbine vane.

Alternatively the component is part of a combustor section of a gas turbine engine.

BRIEF DESCRIPTION OF THE DRAWINGS

The present invention will now be described by way of example with reference to the following figures in which.

DETAILED DESCRIPTION OF THE INVENTION

Figure 1:
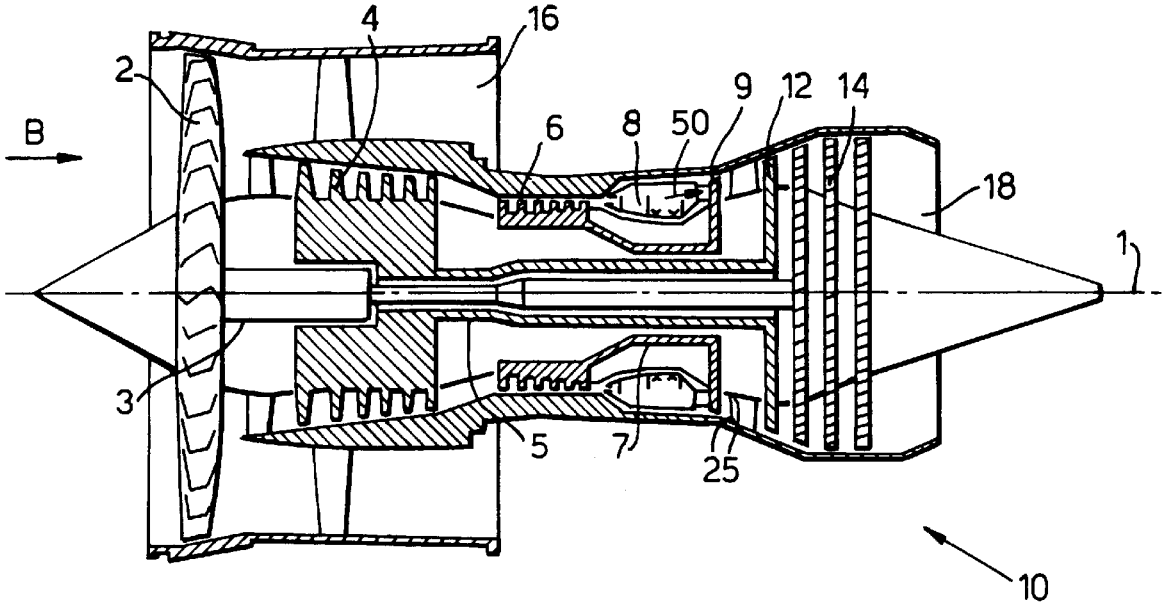
FIG. 1 shows a schematic illustration of a gas turbine engine.

Referring to FIG. 1 an example of a gas turbine engine comprises a fan 2, intermediate pressure compressor 4, high pressure compressor 6, combustor 8, high pressure turbine 9, intermediate pressure turbine 12 and low pressure turbine 14 arranged in flow series. The fan 2 is drivingly connected to the low pressure turbine 14 via a fan shaft 3; the intermediate pressure compressor 4 is drivingly connected to the intermediate pressure turbine 12 via a intermediate pressure shaft 5; and the high pressure compressor is drivingly connected to the high pressure turbine via a high pressure shaft 7. In operation the fan 2, compressors 4,6, turbine 9,12,14 and shafts 3,5,7 rotate about a common engine axis 1. Air, which flows into the gas turbine engine 10 as shown by arrow B, is compressed and accelerated by the fan 2. A first portion of the compressed air exiting the fan 2 flows into and within an annular bypass duct 16 exiting the downstream end of the gas turbine engine 10 and providing part of the forward propulsive thrust produced by the gas turbine engine 10. A second portion of the air exiting the fan 2 flows into and through the intermediate pressure 4 and high pressure 6 compressors where it is further compressed. The compressed air flow exiting the high pressure compressor 6 then flows into the combustor 8 where it is mixed with fuel and burnt to produce a high energy and temperature gas stream 50. This high temperature gas stream 50 then flows through the high pressure 9, intermediate pressure 12, and low pressure 14 turbines which extract energy from the high temperature gas stream 50, rotating the turbines 9,12,14 and thereby providing the driving force to rotate the fan 2 and compressors 4,8 connected to the turbines 9,12,14. The high temperature gas stream 50, which still possesses a significant amount of energy and is travelling at a significant velocity, then exits the engine 10 through an exhaust nozzle 18 providing a further part of the forward propulsive thrust of the gas turbine engine 10. As such the operation of the gas turbine engine 10 is conventional and is well known in the art.

It will be appreciated that in operation the combustor 8 and the turbines 9,12,14, in particular the high pressure turbine 9, are subjected to the high energy and temperature gas stream 50. In order to improve the thermal efficiency of the gas turbine engine 10 it is desirable that the temperature of this stream 50 is as high as possible, and in many cases may be above the melting point of the engine 10 materials. Consequently cooling arrangements are provided for these components subjected to these high temperatures, to protect these components.

Figure 2:
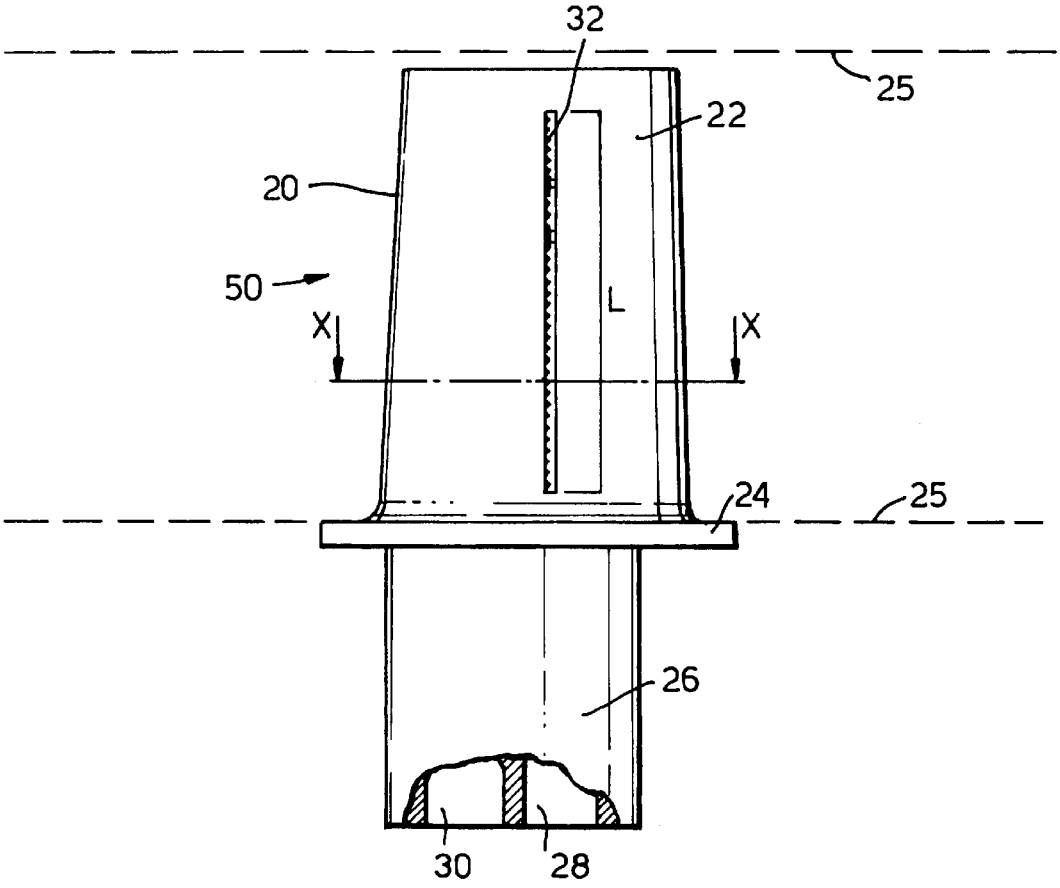
FIG. 2 is an illustration of a turbine blade from the engine shown in FIG. 1 incorporating an embodiment of the present invention.

The turbines 9,12,14 comprise a plurality of blades mounted in an annular array from a disc structure. One of these individual turbine blades 20 from the high pressure turbine 9, which is subject to the high energy and temperature gas stream 50 is shown, diagramatically, in FIG. 2. The blade 20 comprises an aerofoil section 22, a platform section 24, and a root portion 26. When the blade 20 is mounted within the engine 10 the aerofoil section 22 is disposed within, and exposed to, the high temperature gas stream 50. The platform section 24 co-operates with the platform sections 24 of the other blades 20 within the array to define an annular inner ring structure which defines part of an annular turbine duct 25 through which the gas stream flows. This annular turbine duct 25 is shown by phantom lines 25' in FIG. 2. The root portion 26 attaches the turbine blade 20 to a turbine disc.

Figure 3:
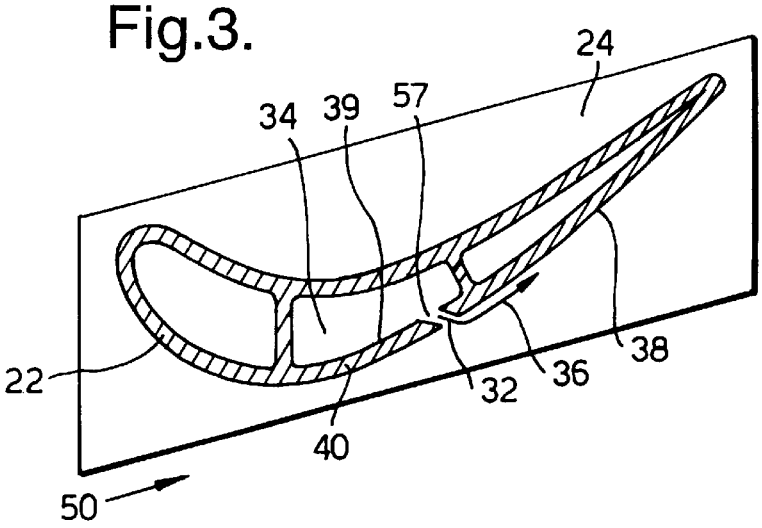
FIG. 3 is a cross sectional view of the turbine blade shown in FIG. 2 through line 3—3.

As shown in FIG. 3 the turbine blade 20 is hollow, with an outer wall 40 enclosing, and defining, a compartmentalised internal cavity 34. Passages 28,30 within the turbine blade root 26 interconnect the internal cavity 34 with cooling air ducts (not shown) in the engine 10. In operation pressurised cooling air, which is conventionally bled from the compressors 4,6 (primarily the high pressure compressor 6) is supplied via the engine cooling ducts and the turbine blade root passages 28,30 to the internal cavity 34 of the turbine blade 20. The pressurised cooling air cools the walls 40 of the turbine blade 20 and flows through, as shown by arrows 52 and 36, passages 57 provided within the walls 40. This flow 36 of cooling air exiting the passages 57 flows in a boundary layer, in a downstream direction, along the surface 38 of the turbine blade 20 exposed to the high temperature gas stream 50. The boundary layer of cooling air provides a protective film of cool air along the surface 38 of the blade 20 and provides film cooling of the blade surface 38 exposed to the high temperature gas stream 50.

It will be appreciated that in a typical turbine blade there may be a number of passages 57, generally in rows, within the entire extent of walls 40 of the blade 20 on both a suction side and pressure side of the blade 20 and at the leading and trailing edges of the blade 20. However for the purposes of clarity and simplification only one such row of passages 57 has been shown.

Figure 4:
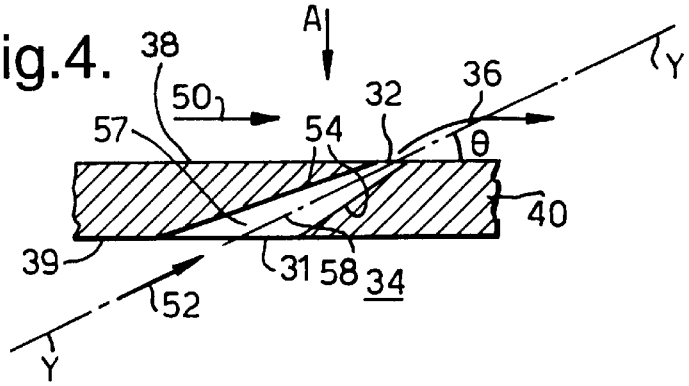
FIG. 4 is a more detailed view of the wall of the turbine blade of FIG. 3 showing a coolant passage therethrough.
Figure 5A:
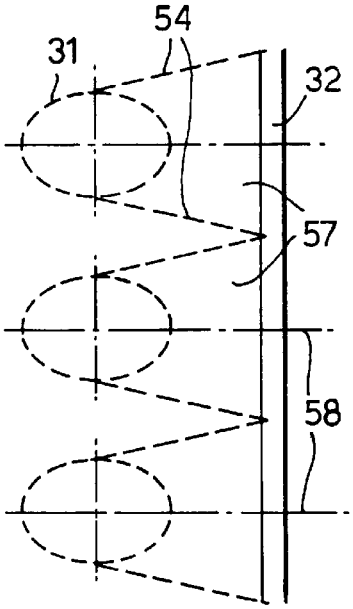
FIG. 5*a* is a view on arrow A of FIG. 4.
Figure 5B:
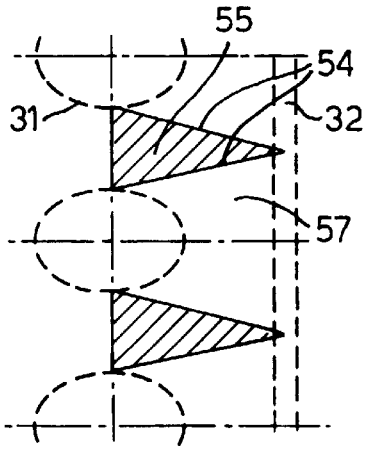
FIG. 5*b* is a sectional view of the wall of the turbine blade on a plane passing through the centreline 5A—5A of the passage of FIG. 4.

The configuration and shape of the passages 57 is shown in more detail in FIGS. 4, 5*a*, and 5*b*. A plurality of discrete inlets 31 are provided in the surface of the wall 40 adjacent to cavity 34. The inlets 31 are arranged in a row extending (spanwise) along the length of the blade 20. The individual passages 57, which are defined by passage walls 54, extend through the walls 40 of the blade 20 from the inlet 31 to an outlet 32 in the surface 38 of the wall 40 exposed to the high temperature gas stream 50.

A central axis 58 passes through the geometric centre of each of the passages 57, and, as shown, the passages 57 are angled in the direction of the flow of the high temperature gas stream 50. In operation this angling directs the flow 36 of cooling air, as it exits the passages 57, in a downstream direction along the surface 38 of the blade 20. The angle 0 of the central axis 58, and so of the passages 57, to the wall surface 39 is typically between 20 and 70 degrees.

The inlet 31 to the passages 57 has a substantially circular cross section in the flow 52 direction (perpendicular to the central axis 58). It being appreciated that due to the angle θ of the passage 57 relative to the wall surface 39, as shown by the central axis 58, a circular cross section inlet 31 forms an elliptical hole in the wall surface 39, as shown in FIGS. 5*a* and 5*b*.

The walls 54 of the passages 57 define the passages 57 as they pass through the wall 40 of the blade 20 as shown in FIGS. 4, and 5*a*. As shown in FIG. 5*a*, which is a view on arrow A of the surface 38 of the wall 40, from the passage inlet 31 to the outlet 32 on the wall surface 38 the walls 54 of the individual passages 57 diverge laterally within the wall 40 in a direction generally parallel to the wall surfaces 38,39. At or near the blade wall surface 38 the walls 54 of adjacent passages 57 intersect to define a common outlet slot 32 in the wall surface 38. This outlet slot 32 is most clearly seen in FIG. 2. In a cross sectional plane through the wall 40 from the cooling air surface 39 of the wall to the exposed surface 38 of the wall, and containing the passage central axis 58, the walls 54 however converge on the central axis 58 from the inlet 31 to the outlet 32, as shown in FIG. 4. From the inlet 31 to the outlet slot 32 the walls 54 of the passages 57 therefore diverge in one direction (laterally) whilst also converging in a second substantially orthogonal direction (substantially perpendicular to the wall surfaces 38,39).

The cross section of the passages 57 in the flow direction 52 through the passages is generally circular at the inlet 31. Then, as the passage 57 passes through the wall 40, and due the profiling of the walls 54, the cross section is smoothly developed into a generally rectangular shape, in the form of a common outlet slot 32, at the passage outlet. It will be appreciated though that the inlet 31 cross section is not critical and the inlet 31 could be elliptical, circular, rectangular or any other shape.

The profiling of the passage walls 54 is such that the convergence of the walls 54 (as shown in cross sectional side view in FIG. 4) is greater than the divergence of the walls 54 (as shown in plan view in FIG. 5*a*). Therefore overall the configuration of the passages 57 converges and the cross sectional area of the passages 57 reduces, in the flow 52 direction, from the inlet 31 to the outlet 32.

As shown in FIG. 5*b* and 5*a* inside the wall 40 adjacent passages 57 are separated by roughly triangular pedestals 55, defined in part by the passage walls 54. These pedestals 55 tie the walls together and maintain the strength of the wall 40. This provides mechanical strength superior to a simple slot arrangement.

Preferably the basic shape of each of the passages 57 is generated by a family of straight lines passing through the wall 40 in a similar way to the central axis 58. As such the passages can be manufactured by linear drilling, for example by using a laser. Other conventional methods could however be used to manufacture the passages. For example they could also be produced by electrode discharge machining or water jet drilling. Alternatively the walls 40 and cooling passages 57 could be manufactured by precision casting.

In operation cooling air within the cavity 34 flows into the passage inlet 31 and through the passages 57 defined by the passage walls 54, as shown by arrow 52 in FIG. 4. As the cooling air flows through the passages 57, defined by the laterally diverging walls 54, it spreads out laterally. At the outlet 32 the cooling air is combined, within the common outlet slot 32, with cooling air flow 36 from adjacent passages 57 such that the cooling air flow 36 exits the outlet slot 32 as a film of cooling air extending along the length L of the slot 32. Due to the shallow angle θ of the passages 57, relative to the wall surface 38, and the flow of the high temperature gas stream 50 along the surface of the wall 38, the film of cooling air flow 36 exiting the outlet slot 32 flows downstream along the surface 38 in a boundary layer. This boundary layer along the surface 38 provides the required film cooling of the surface 38 and protection of the surface 38 from the high temperature gas stream 50. As such the flow 52,36 through and out of the passages 57 is similar to other prior art arrangements in which cooling air flows through a slot outlet to provide a boundary layer film.

However according to the invention, due to the combined overall convergence and reduction in overall cross sectional area of the passages 57, between the inlet 31 and outlet 32, the cooling air flow 52,36 is accelerated as it flows through the passages 57. The minimum throat area of the passages 57 and hence the maximum flow velocity is preferably arranged at or just before the passage outlet 32. This acceleration of the cooling air flow through the passages 57 due to the reduction in overall cross section is an important aspect of the invention. Such an arrangement being completely against the teaching of conventional cooling passage designs which are arranged to decelerate the flow through passages which only have overall divergent and increasing cross sectional area passages.

It has been found that accelerating the cooling air flow 52,36 as it flows through the passages 57 has a number of advantages. Firstly it minimises inlet flow separations that can occur with prior art designs where the flow is decelerated. It also minimises the aerodynamic losses associated with flow 52,36 through the passages 57 and/or allows higher cooling air flows 52,36 without additional aerodynamic performance penalties, as compared to the prior art arrangements that decelerate the cooling air flow 52,36. Additionally by accelerating the flow 52,36 of the cooling air through the passages 57 an improved, near laminar and relatively thin boundary layer film flow 36 of cooling air is provided along the surface 38 of the blade 20. This boundary layer, produced by this arrangement, is more stable, and the cooling air flow 36 at the outlet 32 is less turbulent than that produced in the prior art methods. This inhibits mixing of the cooling air flow 36 along the surface 38 with the high temperature gas stream 50 which improves film cooling and provides an improved protective barrier over the surface 38 of the blade 20. The overall convergence and reduction in cross section of the passages 57 also improves the lateral distribution and spreading out of the cooling air flow 52,36 within the passages 57 to produce a near uniform, or more uniform, cooling film across the length L of the outlet slot 32. The arrangement according to the invention also combines these benefits with those of a slot type outlet, and/or passage, in which the cooling air flow is spread out over the surface 38 of the blade 20.

In this arrangement the outlet flow 36 from the passage outlet slot 32 is also kept on the surface 38 of the wall by the Coanda Effect which is also improved by accelerating the cooling air flow 36. This reduces the tendency of the outlet flow 36 to lift off from the surface 38 of the blade 20, which can occur with other arrangements. Such lift off of the flow over the surface 38 of the blade 20 adversely affects the film cooling of, and protection provided to, the blade wall 40. Consequently this arrangement can be used with higher flow rates of cooling air which provide improved film cooling. Such higher cooling air flow rates are difficult to provide with prior art arrangements due to the tendency of the flow produced along the walls to lift off.

Further embodiments of the invention are shown in FIGS. 6 to 11. These embodiments are generally similar to the embodiment described in detail above. Consequently only the differences between these embodiments and the above arrangement will be described, and like reference numerals have been used for like features. Furthermore although the additional individual features of the successive embodiments have been combined in FIGS. 6 to 11 it is contemplated that they can be used separately or in different combinations in other further embodiments.

Figure 6:
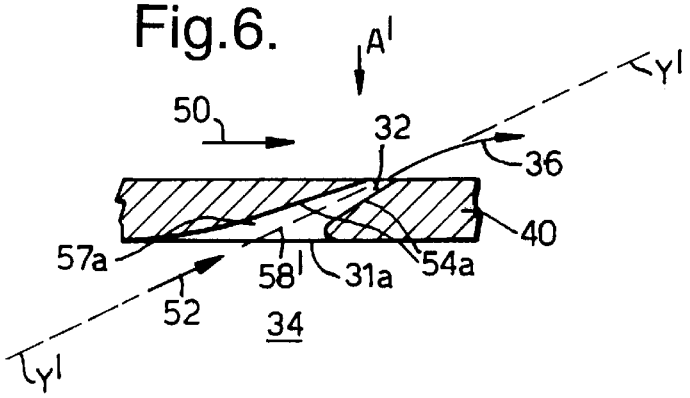
FIG. 6 is a similar view to that of FIG. 4 but of an alternative embodiment of the present invention.
Figure 7:
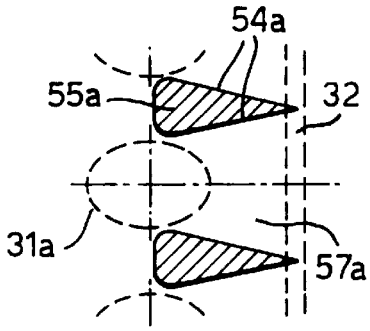
FIG. 7 is a sectional view of the wall of the turbine blade on a plane passing though the centreline 66 of the passage of FIG. 6.

In a second embodiment of the invention as shown in FIGS. 6 and 7 the inlet 31*a* to the passages 57*a* has a rounded profile. This further minimises inlet flow separations and further improves the aerodynamic efficiency of this arrangement.

Figure 8:
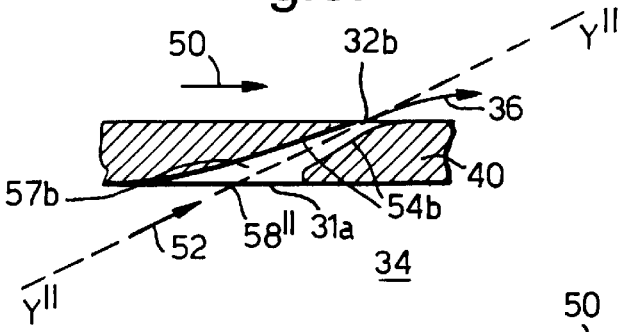
FIG. 8 is a similar view to that of FIG. 4 but of another alternative embodiment of the present invention.

As shown in the embodiment illustrated in FIG. 8 the outlet slot 32*b* can also be faired or rounded into the surface of the wall 38. This reduces any exit separations of the cooling air flow 36. Furthermore such rounding of the outlet slot 32*b* improves the Coanda effect associated with the outlet 32*b* which further reduces any tendency of the outlet flow 36 to lift off from the surface 38.

Figure 9:
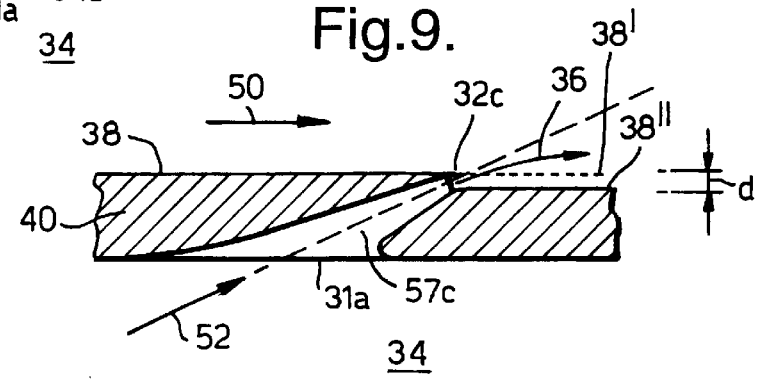
FIG. 9 is a similar view to that of FIG. 4 but of a further embodiment of the present invention.

In the embodiment shown in FIG. 9 the surface 38" of the wall exposed to the high temperature gas stream 50 downstream of the outlet slot 32*c* is lower than the surface 38 upstream of the outlet slot 32*c*. The extended position of the upstream surface 38 being shown by phantom line 38'. The distance d between the downstream surface 38" and the position of extended surface 38' is preferably equal to the displacement thickness which would accommodate the cooling flow 36 without disturbing the main flow 50, ignoring mixing, caused by the flow 36 of cooling air flow from the outlet 32*d*. By this arrangement the high temperature gas stream 50 is less disturbed by the flow 36 of cooling air from the outlet 32*d* and along the surface 38" of the wall 40 while maintaining the high cooling effectiveness of the cooling near to the wall 40. This arrangement is particularly advantageous if the high temperature gas stream 50 is flowing over the surface 38 at a high Mach number, and hence velocities, where the arrangement reduces loss inducing shock waves which may be generated by the flow 36 of cooling air from the outlet 32*c*.

Figure 10:
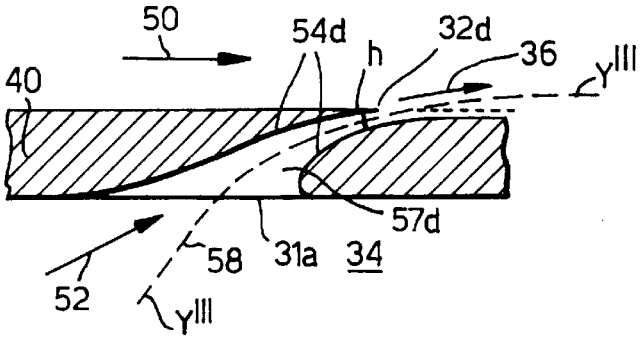
FIG. 10 is a similar view to that of FIG. 4 but of a yet further embodiment of the present invention.
Figure 11:
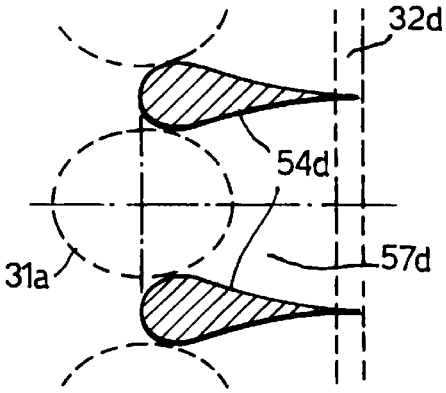
FIG. 11 is a sectional view of the wall of the turbine blade on a notional surface passing through the centreline 10—10 of the passage of FIG. 10.

In the embodiment shown in FIG. 10 and 11 the passages 57*d* still have a laterally divergent profile in one direction (FIG. 11), and a convergent profile in another direction (FIG. 10), with the overall cross section converging and reducing towards the passage outlet 32*d* such that the cooling flow is accelerated through the passage 57*d*. However the walls 54*d*, and profiling of the passages 57*d* through the wall 40 are curved rather than straight sided as in the previous embodiments. The passage 57*d* is also curved as it passes through the wall 40 as shown by the curved, notional, central axis 58 of the passage 57*d*. This curved profiling improves the flow 52 of cooling air through the passages 57*d*. Furthermore by curving the passages 57*d*, as shown by the notional central axis 58, the angle θ of the passage outlet 32*d* relative to the wall surfaces 38 can be reduced as compared to the case with straight walled passages 57. This improves the flow 36 of cooling air film along the downstream wall surface 38" and further reduces any tendency of the film to lift off the surface 38". In this embodiment the basic shape of the passages 57*d* is no longer generated by a family of straight lines, as is generally the case in the previous embodiments, and the passages 57*d* and walls 40 are typically manufactured by precision casting to achieve the curved profile. It being appreciated that other conventional methods of producing the passages are generally not applicable to producing such curved passages 57*d*.

Although not shown it will also be appreciated that the cross section and height h of the outlet slot 32*d* can be varied along its length L, and in particular across each passage L1 in order to improve the lateral distribution of the cooling flow 36 over the surface 38".

The invention has been described with reference to cooling turbine blades 20. It will be appreciated though that the invention can also be applied to, and used on, the nozzle guide vanes of a turbine to provide improved cooling to the surfaces and walls of the vanes similarly exposed to the high temperature gas stream 50. Such nozzle guide vanes having a similar aerofoil and platform sections and also generally being hollow with an internal cavity defined by vane walls. Cooling air being supplied to the internal cavity of the vanes and passing through cooling passages within the vane walls thereby providing cooling and protection of the vanes.

It will further be appreciated and contemplated by those skilled in the art that the cooling passage arrangement and configuration could also equally well be applied to other components which are required to be film cooled. For example the walls of the combustor are conventionally provided with film cooling and the invention can be advantageously applied to providing film cooling of such combustor walls.

What is claimed is:

1. A gas turbine engine component comprising a wall with a first surface which is adapted to be supplied with a flow of cooling air, and a second surface which is adapted to be exposed to a hot gas stream, the wall further having passage walls which define therein a plurality of passages, which interconnect passage inlets in said first surface of the component to passage outlets in said second surface, the passages, passage walls defining the passages, cooling air and the hot gas stream being arranged such that in operation a flow of cooling air is directed from the passage inlets to the passage outlets through said passages to provide a flow of cooling air over at least a portion of the second surface;

wherein a cross sectional area of each of the passages in a direction of cooling air flow through a passage progressively decreases overall from the passage inlets to the passage outlets such that in use the flow of cooling air from the passage inlets to the passage outlets through each passage is accelerated, each passage having a centerline, the passage walls, which define the passages through the walls of the component, being profiled such that in a first direction substantially perpendicular to a flow direction through the passage, they converge towards said respective centerline through the passage, and in a second direction also perpendicular to a cooling flow direction through the passage they diverge from the centerline of the passage.

2. A gas turbine engine component as claimed in claim 1 in which the passage outlet in said second surface comprises a slot defined by the passage in said second surface.

3. A gas turbine engine component as claimed in claim 2 in which the passage inlet in said first surface has a different shape to the passage outlet slot.

4. A gas turbine engine component as claimed in claim 1 in which the passage outlets of at least two of the plurality of passages are combined to produce a common outlet.

5. A gas turbine engine component as claimed in claim 1 in which, at the passage outlet of at least two adjacent passages, at least part of the passage walls defining the adjacent passages substantially intersect the second surface of the wall exposed to the hot gas stream.

6. A gas turbine engine component as claimed in claim 1 in which the cross section, substantially perpendicular to the direction of flow through the passage, of the passage inlet is substantially circular.

7. A gas turbine engine component as claimed in any one of claims 1 to 5 in which the cross section, substantially perpendicular to the direction of flow through the passage, of the passage inlet is substantially elliptical.

8. A gas turbine engine component as claimed in any one of claims 1 to 5 in which the cross section, substantially perpendicular to the direction of flow through the passage, of the passage inlet is substantially rectangular.

9. A gas turbine engine component as claimed in claim 1 in which the first direction in which the passage walls diverge is substantially parallel to the first and second surfaces of the wall of the component, and the second direction is substantially perpendicular to the first direction and the centre line through the passage, such that from the passage inlet to the passage outlet the passage walls that define the passages are configured to diverge in the first direction laterally across the wall of the component and also simultaneously converge in the second direction.

10. A gas turbine engine component as claimed in claim 1 in which the passages through the walls of the component are angled in a flow direction of the hot gas stream that is arranged in operation to flow adjacent to the second surface of the component.

11. A gas turbine engine component as claimed in claim 1 in which at the passage inlet, where the walls of the passages and the first surface of the wall of the component intersect, a rounded profile is defined between the passage walls and the first surface.

12. A gas turbine engine component as claimed in claim 1 in which at the outlet to the passages, where the walls of the passages and the second surface of the wall of the component intersect, a rounded profile is defined between the passage walls and second surface.

13. A gas turbine engine component as claimed in claim 1 in which a portion of the second surface of the wall exposed to hot gas stream downstream of a passage outlet is lower than a portion of the second surface upstream of the passage outlet.

14. A gas turbine engine component as claimed in claim 1 in which the passages are curved as they pass through the wall of the component.

15. A gas turbine engine component as claimed in claim 1 in which the passage walls that define the passages have a curved profile.

16. A gas turbine engine component as claimed in claim 1 in which the component is part of a turbine section of a gas turbine engine.

17. A gas turbine engine component as claimed in claim 1 in which the component is a hollow turbine blade.

18. A gas turbine engine component as claimed in claim 1 in which the component is a hollow turbine vane.

19. A gas turbine engine component as claimed in claim 1 in which the component is part of a combustor section of a gas turbine engine.

* * * * *